United States Patent [19]

Lechert et al.

[11] Patent Number: 4,871,426

[45] Date of Patent: Oct. 3, 1989

[54] PROCESS FOR REPROCESSING WASTE MATERIAL

[75] Inventors: Hans Lechert; Volkert Woebs-Gosch; Song Qun, all of Hamburg; Walter Kaminsky, Pinneberg-Waldenau; Hansjörg Sinn, Noderstedt, all of Fed. Rep. of Germany

[73] Assignee: Asea Brown Boveri Aktiengesellschaft, Mannheim, Fed. Rep. of Germany

[21] Appl. No.: 289,608

[22] Filed: Dec. 23, 1988

[30] Foreign Application Priority Data

Dec. 23, 1987 [DE] Fed. Rep. of Germany ..... 3743752

[51] Int. Cl.[4] ..... C10B 53/00; C07C 4/00

[52] U.S. Cl. ..... 201/2.5; 201/45; 585/241

[58] Field of Search ..... 201/2.5, 25, 30, 45; 585/241

[56] References Cited

U.S. PATENT DOCUMENTS 4,203,804 5/1980 Janning et al. ..... 201/2.5
4,584,421 4/1986 Saito et al. ..... 585/241
4,746,406 5/1988 Timmann ..... 201/25

FOREIGN PATENT DOCUMENTS 58-172322 10/1983 Japan ..... 585/241

*Primary Examiner*—Joye Woodard

[57] ABSTRACT

A liquid fraction and a gas fraction produced during the reprocessing of waste material containing CH compounds by pyrolysis, have a mass ratio approximately equal to 1. Since the liquid fraction is more suitable for further processing than the gas fraction, there is an incentive to augment the liquid fraction at the expense of the gas fraction. In order to achieve this object, the pyrolysis gas is cooled until the benzene and the higher-boiling gaseous constituents of the pyrolysis gas pass into the liquid phase, so that a benzene-containing liquid fraction is produced. A gas mixture containing benzene and toluene is stripped out of the benzene-containing liquid fraction, passed together with the gas fraction at a temperature of 300° to 450° C. over a zeolitic catalyst and then separated by cooling into both a fraction which is liquid at atmospheric pressure and a residual gas fraction. As a result, the proportion of the liquid fraction is substantially increased and the economics of the process are substantially improved.

16 Claims, 3 Drawing Sheets

PROCESS FOR REPROCESSING WASTE MATERIAL

BACKGROUND OF THE INVENTION

1. Field of the Invention

The invention relates to a process for reprocessing waste material containing hydrocarbon compounds, in particular waste material which contains plastic or rubber wastes and is decomposed pyrolytically and the pyrolysis gas generated is converted by cooling into a liquid fraction and a gas fraction.

2. Description of the Related Art

From the general state of the art, it is known to form a liquid fraction from the pyrolysis gas obtained in the pyrolysis of the waste material, by means of partial condensation of the pyrolysis gas, which is effected by cooling, with the non-condensed remaining pyrolysis gas arising as a gas fraction. The liquid fraction/gas fraction weight ratio has a value of approximately 1.

The gas fraction, which contains mainly hydrogen, methane, ethane, ethene, propane, propene and small quantities totalling about 5% by volume of higher saturated and unsaturated hydrocarbons, is utilized to the extent of about 15 to 30% of weight for carrying out the pyrolysis process. This preferably takes place by using the gas fraction as fuel gas and/or, in the case of pyrolysis in a fluidized bed, by using it as fluidizing gas. In spite of its interesting components, the still remaining gas fraction can hardly be sold in the market and storage, transport and processing are also expensive and difficult to carry out. By contrast, the utilization or further use of the liquid fraction, which contains valuable constituents such as benzene, toluene and xylene (BTX aromatics, does not cause any problems.

SUMMARY OF THE INVENTION

It is accordingly an object of the invention to provide a process for reprocessing waste material, which overcomes the hereinafore-mentioned disadvantages of the heretofore-known methods of this general type and to augment the liquid fraction in such a process in a simple manner.

With the foregoing and other objects in view there is provided, in accordance with the invention, a process for reprocessing waste material containing hydrocarbon compounds, in particular waste material containing plastic or rubber wastes, the waste material being decomposed pyrolytically and pyrolysis gas generated being converted by cooling into a liquid fraction and a gas fraction, which comprises cooling the pyrolysis gas until gaseous benzene contained therein as well as gaseous pyrolysis gas constituents boiling higher than benzene pass into the liquid phase and a benzene-containing liquid phase is formed, stripping a gas mixture containing benzene and toluene out of the benzene-containing liquid fraction, contacting the gas mixture together with the gas fraction with a zeolitic catalyst as a temperature of 300° to 450° C., and separating the catalytically treated gas mixture by cooling into both a fraction which is liquid at ambient pressure and a residual gas fraction.

Thus, the pyrolysis gas is cooled to such an extent that the gaseous benzene contained therein, including the constitutents which have a boiling point higher than that of benzene, pass into the liquid phase and a benzene-containing liquid fraction is formed. Since benzene has a boiling point of 80° C. of ambient pressure and the cooling is carried out approximately at ambient pressure, the pyrolysis gas must be cooled to approximately 75° to 80° C., in order to obtain the benzene-containing liquid fraction. This benzene-containing liquid is then heated to a temperature above the boiling point of toluene and a gas mixture is stripped out which, together with the gas fraction which has remained after the isolation of the benzene-containing liquid fraction, is passed over a zeolitic catalyst at an elevated temperature. At this stage, the olefins present in the gas fraction react with the lower-boiling, liquid-fraction constituents which are in the gaseous form, in particular benzene and toluene to give condensable products. Ethylbenzene is in this case formed from benzene and ethene. Surprisingly, isopropylbenzene is not at all formed in such a quantity as would have corresponded to the original propene content of the residual gas fraction. Rather, it must be assumed that propene reacts with propene itself to give benzene, which is alkylated. Taken as a whole, a catalytically treated gas mixture is formed which contains a large number of alkylated aromatics. These aromatics are separated by cooling into a fraction, which is liquid under ambient pressure, and a residual gas fraction. It was found in this case that more than 80 to 90% by weight of the olefins contained in the gas fraction have disappeared and had been converted into hydrocarbons which are liquid and are thus easily transportable and salable in the market.

The remaining residual gas fraction, in which then only very small quantities of olefins are present (approximately 3% by weight), mainly contains hydrogen, methane, ethane, propane and traces of unsaturated and saturated higher hydrocarbons. Even though this residual gas fraction then amounts only to 30 to 35% by weight of the feedstock, it is still fully adequate to operate the pyrolysis process in a self-sustaining manner. The residual gas fraction still contains sufficient proportions of saturated C1 to C30-hydrocarbon compounds and is therefore entirely suitable and sufficient for use, for example, as fuel gas and fluidizing gas for carrying out the pyrolysis process.

With the objects of the invention in view, there is also provided a process for reprocessing waste material containing hydrocarbon compounds, in particular waste material containing plastic or rubber wastes, the waste material being decomposed pyrolytically and pyrolysis gas generated being converted by cooling into a liquid fraction and a gas fraction, which comprises cooling the pyrolysis gas to a temperature at which a specific gas fraction is produced in which contents of C2 and C3-olefines and of C6-and C7-aromatics are in a molar ratio of approximately 1 and preferably 0.8 to 1.2, contacting the specific gas fraction with a zeolitic catalyst at a temperature of 300° to 450° C., and separating the catalytically treated specific gas fraction by cooling into both a fraction which is liquid at atmospheric pressure and a residual gas fraction.

This process is distinct from the first approach since no liquid fraction is isolated initially from the pyrolysis gas and no gas mixture containing benzene and toluene is produced from it. Rather, the pyrolysis gas is cooled only to that temperature at which a specific gas fraction is produced which contains proportions of C2 and C3-olefines as well as C6 and C7-aromatics, the C2 and C3-olefines/C6 and C7-aromatics molar ratio being approximately 0.8 to 1.2, and preferably approximately 1. In order to produce this specific gas fraction, the pyrolysis gas must be cooled to a temperature of approximately 80° to 100° C. The specific gas fraction is then treated further in exactly the same way as in the first approach and with the same end result.

In accordance with another mode of the invention, the in order to obtain the specific gas fraction, it is expedient to cool the specific gas fraction to a temperature above the boiling point of benzene, preferably to a temperature which is at most 10° to 20° C. above the boiling point. Since the process is carried out at approximately ambient pressure, the boiling point data relate to ambient pressure. If cooling is carried out at a pressure other than ambient pressure, the cooling temperature must be varied corresponding to the pressure.

In accordance with a further mode of the invention, which is suitable particularly for the processing of waste material up to an annual throughput of 10,000 tons, the catalyst is in the form of fixed-bed catalyst and the contact time of the gas mixture or specific gas fraction with the catalyst is fixed at 0.3 to 2 seconds, preferably 0.7 to 1.5 seconds.

At higher throughputs of more than 10,000 tons per year, in accordance with an added mode of the invention, it is advisable to use the catalyst in a fine granular form and to employ it for forming a fluidized bed, the contact time of the gas mixture or specific gas fraction with the fluidized bed being 0.4 to 1.5 seconds, preferably 0.5 to 1.1 seconds.

In accordance with an additional mode of the invention, in order to maximize the liquid fraction, the gas mixture or specific gas fraction is contacted with the catalyst at a temperature of 350° to 410° C.

For the same reason, In accordance with a concomitant mode of the invention, it is expedient to use the commercially available catalyst ZSM5 as the catalyst.

Other features which are considered as characteristic for the invention are set forth in the appended claims.

Although the invention is illustrated and described herein as embodied in a process for reprocessing waste material, it is nevertheless not intended to be limited to the details shown, since various modifications may be made therein without departing from the spirit of the invention and within the scope and range of equivalents of the claims.

BRIEF DESCRIPTION OF THE DRAWINGS

The method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
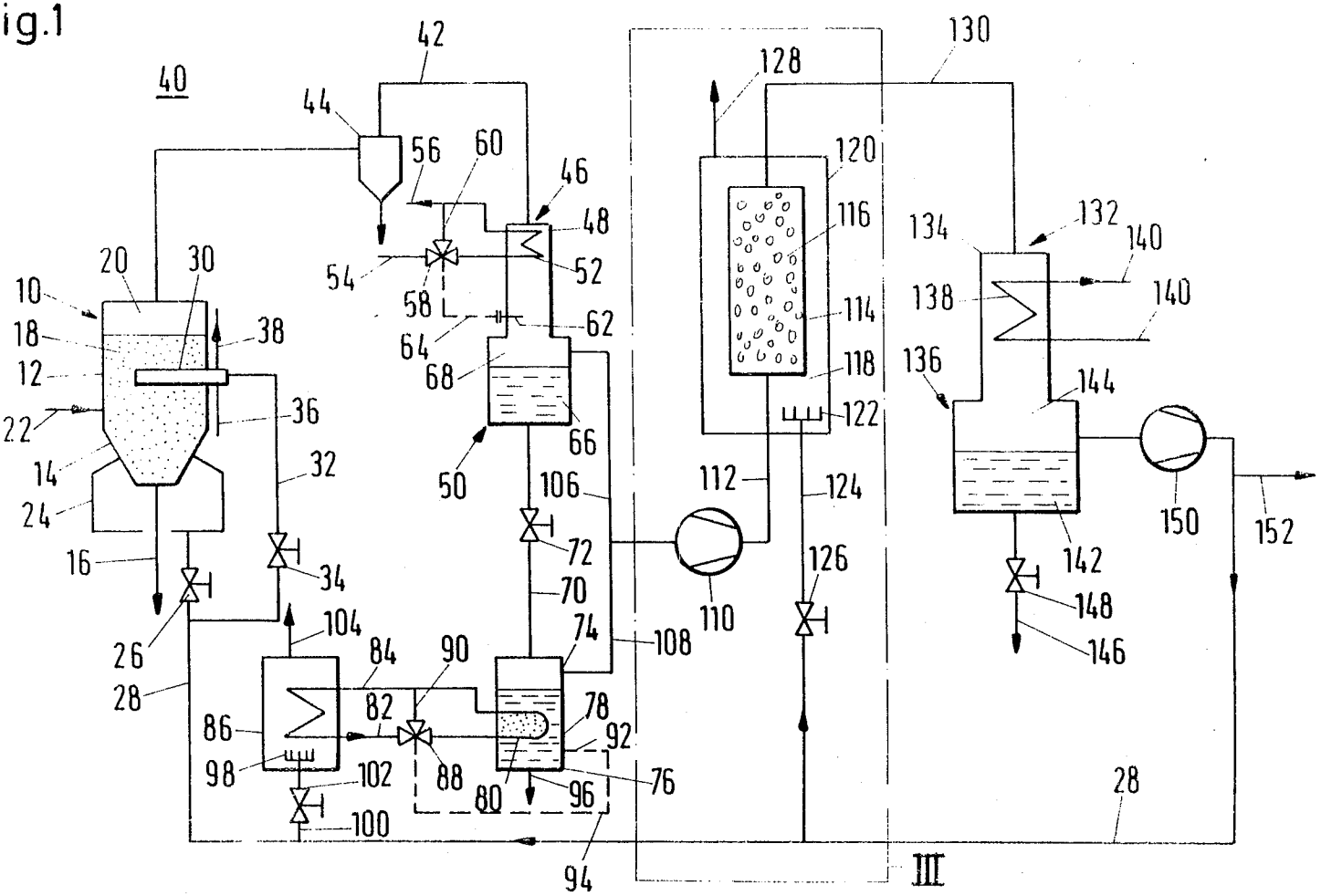
FIG. 1 is a schematic and block circuit diagram of a pyrolysis installation for carrying out a process according to a first embodiment of the invention.

Referring now in detail to the figures of the drawing in which identical components which recur in the individual figures are provided with reference numerals only to the extent that this is necessary for understanding of the invention, and first, particularly, to FIG. 1 thereof, there is seen an installation containing an upright pyrolysis reactor 10, the upper region 12 of which has a circular-cylindrical form. The lower, downwardly adjoining region 14 tapers downwards to a circular-conical form and is provided at its end with a discharge line 16. The fluidized bed 18 forming in the pyrolysis reactor during the reaction has a vertical height which is approximately 80 to 90% of the clear height of the pyrolysis reactor, so that a gas space 20 remains free above the fluidized bed. In order to introduce the waste material into the pyrolysis reactor, a feed line 22 is provided which leads into the fluidized bed 18. Fluidizing-gas lines 24, which are connected to the gas line 28 with insertion of a control and isolation element 26, are connected to the pyrolysis reactor in the lower region 14. A plurality of heater tubes, of which only a single heated tube 30 is shown in the drawings, for clarity, dip horizontally or vertically into the fluidized bed 18. The gas-fired heated tubes 30 serve for indirect heating of the fluidized bed. For the supply of fuel gas, the heated tubed 30 are connected through a line 32 with an inserted control and isolation element 34 to the gas line 28, which carries the combustible residual gas fraction which is produced in the installation and is used as fuel gas and fluidizing gas. The combustion air required for the combustion is fed to each heater tube through a line 36, and the waste or off-gases are discharged in each case through a waste or off-gas line 38 to the surroundings 40.

The gas space 20 of the pyrolysis reactor is connected by a line 42 to a cooling stage 46, a cyclone separator 44 being inserted into the line 42. The line 42 is connected to the upper end of a cylindrical upright cooler 48 of the cooling stage, and the lower end of the cooler leads into a separator vessel 50. In the cooler itself, a cooling coil 52 is provided, which is supplied through the line 54 with a coolant, preferably cooling water or cooling brine. The coolant is discharged through the line 56. A three-way valve 58 is inserted into the line 54, the third connection of the valve being connected by a line 60 to the line 56. In order to actuate the three-way valve 58, a temperature sensor 62 which is provided in the cooler 48 below the cooling coil 52, is connected to the three-way valve 58 by a control line 64, shown in broken lines. If necessary, a non-illustrated power amplifier is inserted into the control line.

The lower region of the separator vessel 50 serves as the liquid space 66, and free space 68 remaining above serves as the gas space.

The liquid space 66 is connected at the bottom by a line 70 with an inserted isolation and control element 72 to the upper region 74 of an upright, circular-cylindrical and closed vaporization vessel 76. In the lower region 78 of the vaporization vessel, a heating coil 80 is provided and connected by a forward-flow line 82 and a return line 84 to a boiler 86. A three-way mixing valve 88 is in this case inserted into the forward-flow line 82 and connected by means of a mixing line 90 to the return line 84. For actuation of the three-way mixing valve 88, a temperature sensor 92 which is provided in the lower region 78 of the vaporization vessel 76, acts on the three-way mixing valve 88 through a control line 94 drawn in dashes. At the lowest point of the vaporization vessel 76, a line 96 is also provided, into which an isolation element not shown in the drawing is inserted.

The boiler 86 is provided with a gas burner 98, which is connected to the gas line 28 through a line 100 with an inserted control and isolation element 102. The waste or off-gas from the boiler 86 is discharged to the surroundings through a waste or off-gas line 104.

The free space 68 of the separator vessel 50 and the upper region 74 of the vaporization vessel 76 are the inlet of a gas blower or compressor 110. The outlet of the compressor 110 is connected by the line 112 to the lower end of an upright cylindrical vessel 114, in which the catalyst is present in the form of lumpy zeolites 116, this accordingly being a fixed-bed catalyst. For heating the catalyst, the vessel 114 is surrounded by a jacket 120, forming an interspace 118 on all sides. A gas burner 122, which is connected by a line 124 with an inserted control and isolation element 126 to the gas line 28, is provided in the interspace 118 underneath the vessel 114. For discharging the combustion off-gases, an off-gas line 128, leading into the surroundings 40, is connected to the upper region of the interspace 118. The lump size of the zeolites is about 3 to 20 mm.

The upper end of the vessel 114 is connected by a line 130 to a further cooling stage 132. In this case, the line 130 leads into the upper end of an upright circular-cylindrical cooler 134, the lower end of which leads into a further separator vessel 136. In the cooler 134, a cooling coil 138 is provided, which is supplied with cooling water or cooling brine through the lines 140. The upright circular- cylindrical further separator vessel 136 has a lower region 142, which is provided for receiving liquid, whereas the upper region 144, remaining above, is intended for receiving gases. At the lowest point of the lower region 142, a line 146 is connected which is provided with an isolation element 148.

The gas line 28 is connected to the upper region 144 of the further separator vessel 136, with insertion of a gas blower or compressor 150. Downstream of the compressor 150, the gas line 28 is also connected to the line 152, through which excess gas is taken off and passed to consumers, for example for space heating. The consumers are not shown in FIG. 1.

If it should be necessary, it is advisable to insert yet at least one further cooling stage and/or a gas scrubber between the compressor 150 and the upper region 144 of the further separator vessel 136. This will be done whenever the gas at the outlet of the further cooling stage 132 has not yet been cooled to ambient temperture and/or should still contain impurities. The above-mentioned cooling stage and the gas scrubber are not shown in FIG. 1.

During operation, gas which in this case serves as fluidizing gas flows from the gas line 28 through the fluidizinggas lines 24 into the pyrolysis reactor 10. As a result, the fine granular fluidization medium present therein, preferably sand of a particle size less than 0.5 mm, is fluidized and the fluidized bed 18 is formed. The gas mass flow required for producing the fluidized bed is adjusted by the control and isolation element 26. At the same time, the heated tube 30 is fed with gas, which serves in this case as fuel gas, through the line 32 and with a combustion air through the line 36, and the heater tube is heated by the gas combustion to such an extent that it is capable of heating the fluidized bed 18 to a temperature of 400° to 1000° C., preferably 600° to 900° C. The waste or off-gas leaving the heated tube is discharged through the waste or off-gas line 38, preferably to a stack which is not shown. The heat output of the heater tube is adjusted by the control and isolation element 34, by means of which the gas feed can be regulated.

The waste material of a lump size of appropriately about 10 cm as a maximum is introduced through the feed line 22 into the lower region of the fluidized bed and thermally decomposed therein in a reducing atmosphere, that is to say in the absence of oxygen. The combustible pyrolysis gases thus forming collect in the gas space 20 of the pyrolysis reactor 10, whereas the pyrolysis residue is discharged through the outlet line 16 from the pyrolysis reactor.

From the gas space 20, the pyrolysis gas flows through the line 42 to the cooling stage 46, solid particles carried over by the pyrolysis gas being precipitated in the cyclone separator 44. The pyrolysis gas enters the top of the upright cooler 48 and is cooled by the cooling coil 52. For this purpose, the cooling coil 52 is fed through the line 54 with cooling water which, after taking up heat, is discharged through the line 56. In the line 54, a three-way mixing valve 58 is installed which is connected through the line 60 to the line 56. By means of the three-way mixing valve, the temperature and the inflow of the cooling water to the cooling coil are adjusted such that gaseous benzene contained in the pyrolysis gas as well as the higher-boiling gaseous constituents condense and are separated as a liquid fraction. The boiling point of benzene is 80° C. at ambient pressure, and the pyrolysis gas must accordingly be cooled in the cooler 48 to a temperature of about 75° to 79° C. In order to ensure this cooling, a temperature sensor 62 is provided in the cooler 48 below the cooling coil 52, which sensor acts through the control line 64 on the three-way mixing valve 58. For this purpose, the three-way mixing valve is adjusted in such a way that a cooling water flow which achieves the desired cooling is established in the cooling coil 52.

In the cooler 48 not only the benzene condenses, but also those constituents of the pyrolysis gas, the boiling points of which are higher than that of benzene. In particular, the toluene condenses which is contained in the pyrolysis gas and has a boiling point of about 110° C. The condensation in the cooling stage 46 takes place at ambient pressure.

The condensed constituents, which form the benzene- containing liquid fraction, collect in the liquid space 66 of the separator vessel 50 and are passed through the line 70 with an inserted control and isolation element 72 into the upright vaporization vessel 76, where they collect in the lower region 78. The control and isolation element 72 is in this case adjusted such that the liquid space 66 always contains a part of the benzene-containing liquid fraction and a passage of gas from the upper region 74 of the vaporization vessel to the free space 68 of the separator vessel is thus avoided. In the lower region 78 of the vaporization vessel, a heating coil 80 is provided which is connected by the forward-flow line 82 and the return line 84 to the water boiler 86. This boiler is heated by a diagrammatically indicated gas burner 98 which is supplied with fuel gas from the gas line 28 through the line 100 with an inserted isolation and control element 102. The waste or off-gas is discharged to the surroundings through the waste or off-gas line 104.

In the forward-flow line 82, the three-way mixing valve 88 is provided which is connected by the control line 74 to the temperature sensor 92. This temperature sensor 92 is located in the lower region 78 of the vaporization vessel 76 and controls the mass flow and the temperature of the heating water in the heating coil 80. The control is in this case adjusted such that the benzene-containing liquid fraction collected in the lower region 78 is heated to such an extent that the benzene and the toluene are stripped out in the gaseous form and a gas mixture is produced which contains benzene and toluene and collects in the upper region 74. Heating of the benzene-containing liquid fraction takes place at ambient pressure to a temperature above 111° C., preferably to 120° to 140° C. The gas mixture is fed through the line 108 to the compressor 110. At the same time, the gas fraction, which arises in the cooler 48 and remains after ioslation of the benzene-containing liquid fraction, flows through the line 106 to the compressor 110 and is mixed with the gas mixture containing benzene and toluene, so that a total gas stream results. This total gas stream is introduced through the line 112 into the bottom of the vessel 118 and flows upwards through the zeolitic catalyst. The vessel 114 and thus the catalyst 116 are heated by the diagrammatically indicated gas burner 122, which is supplied with fuel gas from the gas line 28 through the line 124 and the control and isolation element 126. The catalyst is in this case heated to a temperature of preferably 350° to 410° C. by the flue gases flowing in the interspace 118 to the waste or off-gas line 128. The cross-section of the vessel and hence of the fixed catalyst bed is selected such that the gas flowing through remains in contact with the catalyst for 0.3 to 2 seconds, preferably 0.7 to 1.5 seconds. While flowing through the catalyst, the gaseous olefines present in the gas fraction react with the gaseous benzene and toluene to give gaseous products which are obtained as a liquid fraction on cooling. As a result, the proportion of the gas fraction is reduced, in favor of the liquid fraction.

For isolating the liquid fraction, the catalytically treated total gas stream leaving the vessel 114 is fed through the line 130 to the further cooling stage 132 and introduced into the top of the upright cooler 134. The cooling coil 138, which is installed there and is supplied through the lines 144 with cooling water or cooling brine, cools the catalytically treated total gas stream to a temperature of 20° to 60° C. The pyrolysis oil thus condensing forms the liquid fraction and flows downwards, together with the remaining gas which represents the residual gas fraction, to the upright further separator vessel 136. The liquid fraction collects in this case in the lower region 142 and the residual gas fraction is present in the upper region 144 of the further separator vessel 136. The liquid fraction is taken off through the line 146 from the further separator vessel and processed further, and the combustible residual gas fraction is fed to the compressor 150 and delivered into the gas line 28. The residual gas fraction is fed as fuel gas to the gas burners and as fluidizing gas to the pyrolysis reactor. The residual gas not required in the installation is passed through the line 152 to further consumers which are not shown in FIG. 1.

Figure 2:
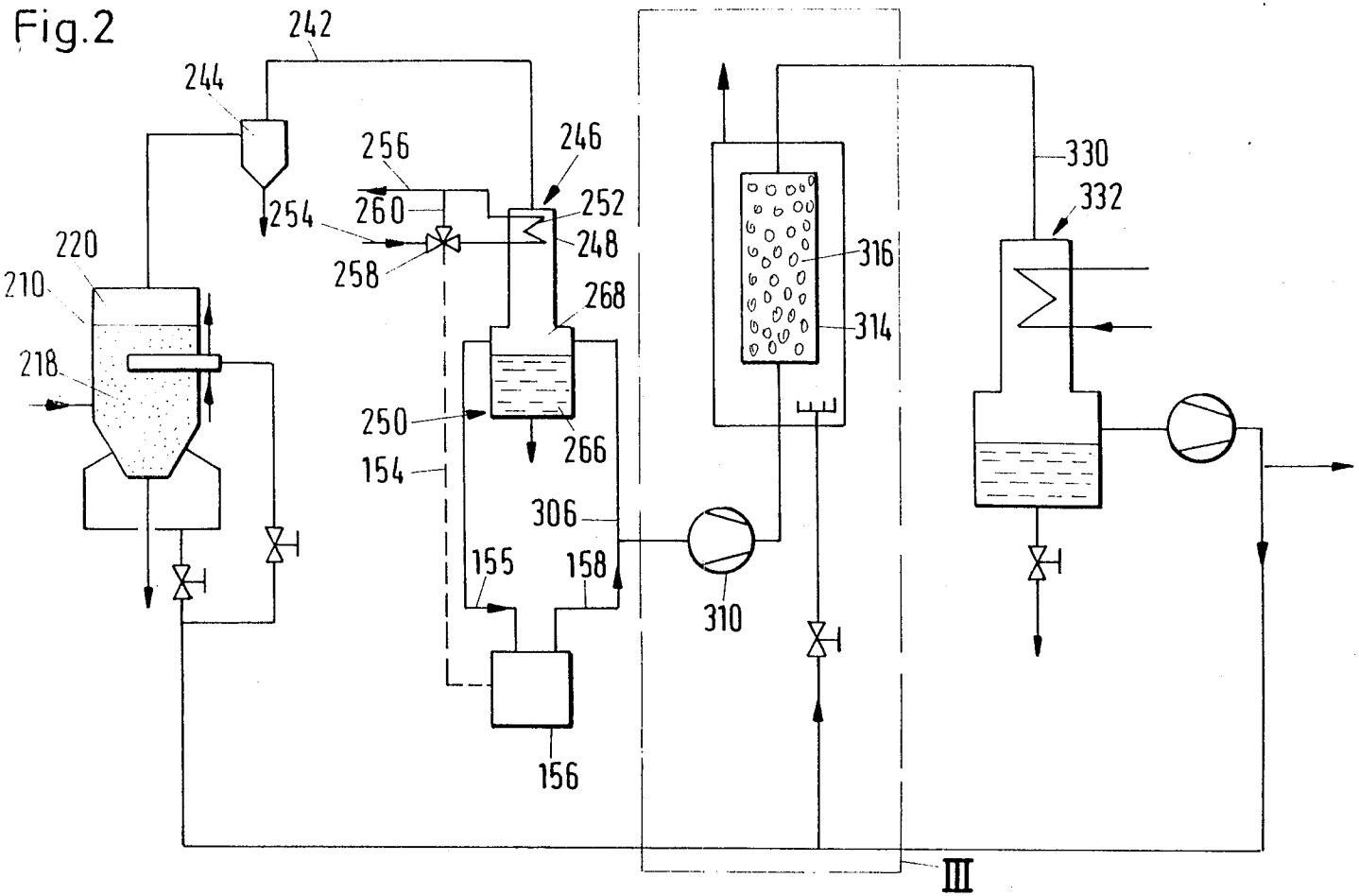
FIG. 2 is a schematic and block circuit diagram of a pyrolysis installation for carrying out the process according to a second embodiment of the invention.

FIG. 2 shows a variation of the embodiment of the pyrolysis installation according to FIG. 1. The difference as compared with FIG. 1 is that the cooling stage is of a different design and the boiler 86 as well as the vaporization vessel 76, connected thereto are omitted. In other respects, components of FIG. 1, which appear in FIG. 2 in an identical form, are provided with reference numerals which are augmented by 200 as compared with the reference numerals of FIG. 1.

The installation according to FIG. 2 includes a cooling stage 246 which has an upright cooler 248. In the cooler, a cooling coil 252 is provided which can be supplied with cooling water in exactly the same way as the cooling coil 52 of FIG. 1. The lower end of the cooler 248 is connected to a separator vessel 250, the lower space of which serves as a liquid space 266, whereas the free space 268 remaining above is provided for receiving gas. From the free space 268, a line 306 leads to the vessel 314 which contains the zeolitic catalyst, a compressor 310 or a gas blower being inserted into the line 306.

The three-way mixing valve 258 provided in the line 254 is connected for control to a measuring and control instrument 156 by the control line 154 drawn in dashes. This measuring and control instrument detects the C2 and C3-olefines/C6 and C7-aromatics molar ratio of the specific gas fraction present in the free space 268. For this purpose, gas is taken through the line 155 from the free space 268 by means of a non-illustrated gas pump, preferably a compressor, passed through the measuring and control instrument and then fed through the line 158 back to the free space 268, or better to the line 306 upstream of the compressor 310, so that a continuous gas stream through the measuring and control instrument 156 is maintained. The measuring and control instrument is now designed in such a way that the three-way mixing valve 258 and hence the cooling output of the cooler 248 are adjusted such that the specific gas fraction arising in the free space has a C2 and C3-olefines/C6 and C7-aromatics molar ratio of approximately 0.8 to 1.2, preferably 1.

During operation of the installation, the waste material is fed tohe pyrolysis reactor 210 and thermally decomposed in the fluidized bed 218, exactly as in the illustrative example according to FIG. 1. The pyrolysis gas produced is passed from the gas space 220 through the cyclone separator 244 to the upper end of the upright cooler 248 which operates at ambient pressure. The pyrolsis gas is cooled here, a part of the pyrolysis gas condensing and being collected as pyrolsis oil in the liquid space 266 of the separator vessel 250. From here, this pyrolysis oil is taken off for further processing.

At the same time, a small part, for example 0.5%, of the cooled pyrolysis gas is passed through the measuring and control instrument 156 and the molar ratio between the C2 and C3-olefines on the one hand and the C6 and C7-aromatics on the other hand is measured. Since this molar ratio is intended approximately to have the value 1, the three-way mixing valve 258 and hence the cooling output of the cooling coil 252 are adjusted by the measuring and control instrument 156 in such a way that the cooled pyrolysis gas in the free space 268 has this desired molar ratio. This pyrolysis gas is designated as the specific gas fraction. In order to obtain the specific gas fraction, cooling of the pyrolysis gas to a temperature above the boiling point of toluene is necessary. The specific gas fraction is then fed through the line 306 with the inserted compressor 310 to the vessel 314, which contains the zeolitic catalyst 316 in a fixed bed. The mode of action of the zeolitic catalyst 316 and the further path ofo the gas is in this case exactly the same as was described in connection with FIG. 1, so that further explanations in this case are unnecessary.

In this embodiment variant, the olefines are converted into saturated C to C5-hydrocarbons, as also in the installation according to FIG. 1, which are obtained as a liquid fraction in the downstream further cooling stage 332 and are taken off from there for further processing. As a result of the process steps according to the invention, the residual gas fractin is reduced by 20 to 30% in favor of the liquid fraction, and the economics of the installation are thus improved.

Figure 3:
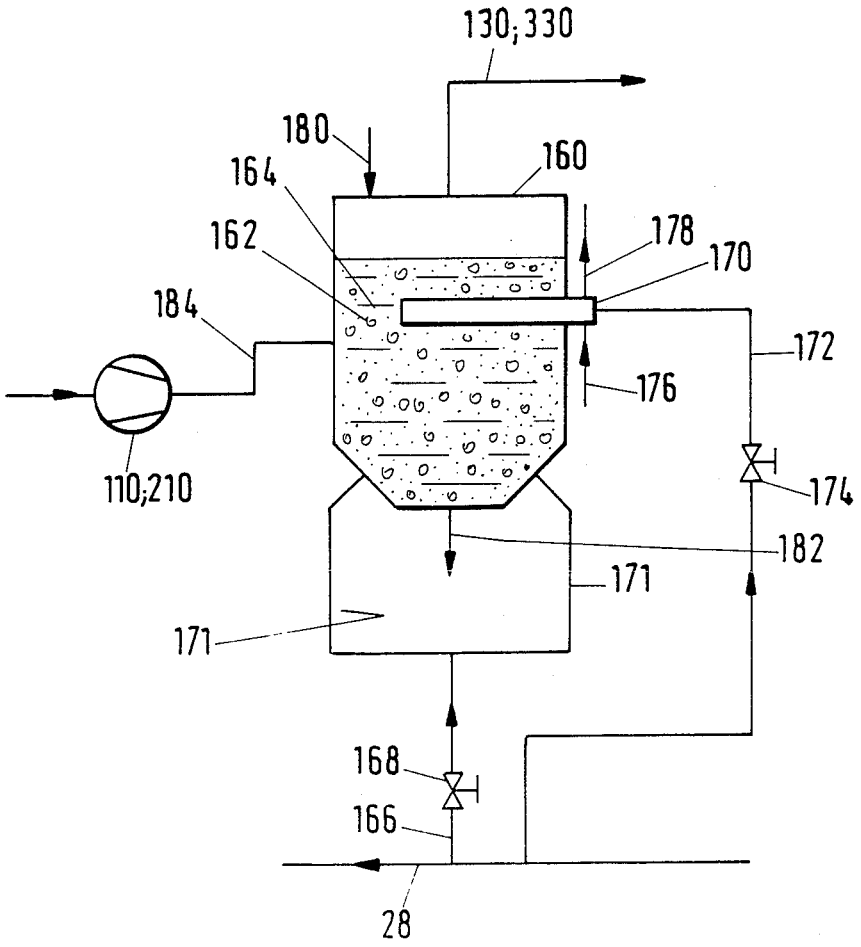
FIG. 3 is an enlarged view of another embodiment of a portion III of the installation shown in FIGS. 1 and 2.

FIG. 3 shows another embodiment the portion III of FIGS. 1 and 2. Instead of the zeolitic catalyst 116 or 316 being in the form of fixed-bed catalyst, the installation according to FIG. 3 has an upright, circular fluidized-bed reactor 160, in which the zeolitic catalyst material 162 forms a fluidized bed 164. For this purpose, the zeolitic catalyst material has a particle size of at most 1 mm and is converted into the fluidized state by means of a fluidizing gas, preferably a part of the residual gas fraction. The fluidizing gas is taken from the gas line 28 and fed through the line 166 with an inserted isolation and control element 168 to he fluidizing-gas lines 171, which introduce it into the lower, circular-conical region of the fluidized-bed reactor 160. The fluidized bed 164 is heated indirectly by gas-fired heater tubes, of which a single heater tube 170 is drawn in FIG. 3. For this purpose, the heater tube is supplied with fuel gas from the gas line 28 through the line 172 with an inserted control and isolation element 174. The combustion air is fed to the heater tube through the line 176, whereas the waste or off-gas flows out through the line 178. The catalyst material is introduced through the line 180 into the top of the fluidized bed reactor, and the spent catalyst material is drawn off through the line 182 from the lower end of the fluidized-bed reactor. The fluidized-bed reactor 160 is of exactly the same structure as the pyrolysis reactor 10 of FIG. 1. Accordingly, it has an upper circular-cylindrical region, which is adjoined by the lower, circular-conical region tapering downwards. The heater tube 170 is introduced horizontally from the external space into the fluidized bed 164. Vertical introduction is equally possible.

As compared to the installations of FIGS. 1 and 2, during operation of the FIG. 3 device, the gas from the cooling stage 46 or 246 is introduced by the compressor 110 or 310 through the line 184 into the fluidized bed 164. The fluidized bed is generated by means of fluidizing gas which is passed through the line 166 and the sufficiently opened control and isolation element 168 to the fluidizing-gas lines 171 and enters the lower region of the fluidized-bed reactor 160. In the fluidized bed 164, the gas fed through the line 184 comes into sufficient contact with the zeolitic catalyst material, so that the reactions described above take place. The requisite temperature of the fluidized bed 164 of preferably 350° to 410° C. is generated by the heater tube 170. The catalytically treated gas mixture or the catalytically treated specific gas fraction then flows through the line 130 or 330 to the further cooling stage 132 or 332 and is further treated in the latter, as described above. The residence time of the gas in the fluidized bed is 0.4 to 1.5 seconds, preferably 0.5 to 1.1 seconds.

As compared with the zeolitic catalyst 116 or 316, which is disposed as a fixed-bed catalyst in a vessel 114 or 314, the catalyst of FIG. 3, in the form of a fluidized bed 164, has the advantage that contacting of the gas with the catalyst material is more intensive.

Good contact of the gas, which is fed through the line 184 to the fluidized-bed reactor 160, with the zeolites of the fluidized bed is obtained even if the gas is used as the fluidizing gas. For this purpose, the line 166 is separated from the gas line 28 and the line 184 is separated from the fluidized-bed reactor 160, and the line 184 is then connected to the line 166. The gas fed through the line 184 then additionally takes over the function of the fluidizing gas. This case is not shown in the drawings.

With respect to the zeolites employed as the catalyst, reference is made to the following article: by Lothar Puppe "Zeolithe - Eigenschaften und technische Anwendungen [Zeolites - Properties and Technical Applications]", Chemie in unserer Zeit [Chemistry in our time], volume 20, 1986, No. 4, VCH Verlagsgesellschaft mbH, 6940 Weinheim/Germany, pages 117 to 127. The preferably used zeolitic catalyst ZSM5, which is also mentioned therein, has the following composition: $Na_{0.3}H_{3.8}[AlO_2)_{4.1}(SiO_2)_{91.9}]$.

EXAMPLES

The effectiveness of the process according to the invention was tested in laboratory experiments. For this purpose, the zeolitic catalyst was introduced into a tube having a 4 mm clear width. A free part of the tube, disposed upstream of the catalyst, served for bringing the gas to the required reaction temperature of 370° C. The adjoining part of the tube is likewise heated to 370° C. and provided for a length L with a bed of the pulverulent, zeolitic catalyst.

The ratio of the reaction zone to the volumetric velocity of the gas at the reaction temperature T is indicated as the residence time t. The residence time has the dimension of seconds.

In the experiments given below, equimolar quantities of benzene and olefines were used. The yield in percent was calculated by the following equation:

$$\frac{(\text{Moles ethylbenzene} + 2\times \text{moles diethylbenzene})\times 100}{\text{Moles benzene} + \text{moles ethylbenzene} + \text{moles diethylbenzene}}$$

All the other products (formed in small quantities) are disregarded. This means that the real yield of alkylated products is higher than the value indicated in each case. The individual experiments give the following results.

| Starting gas | ml/min | T in °C. | L in mm | t in seconds | Yield |
|---|---|---|---|---|---|
| Benzene | 11 | 370 | 90 | 3.0 | 40% |
| Propylene | 11 | | | | |
| Benzene | 11 | 370 | 90 | 3.0 | 75% |
| Ethylene | 11 | | | | |
| Benzene | 11 | 370 | 145 | 4.5 | 80% |
| Ethylene | 11 | | | | |
| Benzene | 22 | 370 | 15 | 0.25 | 70% |
| Ethylene | 22 | | | | |
| Benzene | 22 | 370 | 15 | 0.25 | 66% |
| Ethylene | 22 | | | | |
| Benzene | 22 | 370 | 90 | 1.5 | 75% |
| Ethylene | 22 | | | | |
| Benzene | 22 | 370 | 145 | 2.25 | 85% |
| Ethylene | 22 | | | | |

We claim:

1. Process for reprocessing waste material containing hydrocarbon compounds, the waste material being decomposed pyrolytically and pyrolysis gas generated being converted by cooling into a liquid fraction and a gas fraction, which comprises cooling the pyrolysis gas until gaseous benzene contained therein as well as gaseous pyrolysis gas constituents boiling higher than benzene pass into the liquid phase and a benzene-containing liquid phase is formed, stipping a gas mixture containing benzene and toluene out of the benzene-containing liquid fraction, contacting the gas mixture together with the gas fraction with a zeolitic catalyst at a temperature of 300° to 450° C., and separating the catalytically treated gas mixture by cooling into both a fraction which is liquid at ambient pressure and a residual gas fraction.

2. Process according to claim 1, which comprises forming a fixed-bed of the catalyst, and contacting the gas mixture together with the gas fraction with the catalyst for a contact time of 0.3 to 2 seconds.

3. Process according to claim 1, which comprises forming a fixed-bed of the catalyst, and contacting the gas mixture together with the gas fraction with the catalyst for a contact time of 0.7 to 1.5 seconds.

4. Process according to claim 1, which comprises forming a fluidized bed with the catalyst in a fine granular form, and contacting the gas mixture together with the gas fraction with the fluidized bed for a contact time of 0.4 to 1.5 seconds.

5. Process according to claim 1, which comprises forming a fluidized bed with the catalyst in a fine granular form, and contacting the gas mixture together with the gas fraction with the fluidized bed for a contact time of 0.5 to 1.1 seconds.

6. Process according to claim 1, which comprises contacting the gas mixture together with the gas fraction with the catalyst at a temperature of 350° to 410° C.

7. Process according to claim 1, which comprises selecting the catalyst in the form of a ZSM5 catalyst having the following composition: $Na_{0.3}H_{3.8}[(AlO_2)_{4.1}(SiO_2)_{91.9}]$.

8. Process for reprocessing waste material containing hydrocarbon compounds, the waste material being decomposed pyrolytically and pyrolysis gas generated being converted by cooling into a liquid fraction and a gas fraction, which comprises cooling the pyrolysis gas to a temperature at which a specific gas fraction is produced in which contents of C2 and C3-olefines and of C6 and C7-aromatics are in a molar ratio of 0.8 to 1.2, contacting the specific gas fraction with a zeolitic catalyst at a temperature of 300° to 450° C., and separating the catalytically treated specific gas fraction by cooling into both a fraction which is liquid at atmospheric pressure and a residual gas fraction.

9. Process according to claim 8, which comprises cooling the pyrolysis gas to a temperature above the boiling point of benzene.

10. Process according to claim 8, which comprises cooling the pyrolysis gas to a temperature which is 10° to 20° C. above the boiling point of benzene.

11. Process accoding to claim 8, which comprises forming a fixed-bed of the catalyst, and contacting the specific gas fraction with the catalyst for a contact time of 0.3 to 2 seconds.

12. Process according to claim 8, which comprises forming a fixed-bed of the catalyst, and contacting the specific gas fraction with the catalyst for a contact time of 0.7 to 1.5 seconds.

13. Process according to claim 8, which comprises forming a fluidized bed with the catalyst in a fine granular form, and contacting the specific gas fraction with the fluidized bed for a contact time of 0.4 to 1.5 seconds.

14. Process according to claim 8, which comprises forming a fluidized bed with the catalyst in a fine granular form, and contacting the specific gas fraction with the fluidized bed for a contact time of 0.5 to 1.1 seconds.

15. Process according to claim 8, which comprises contacting the specific gas fraction with the catalyst at a temperature of 350° to 410° C.

16. Process according to claim 8, which comprises selecting the catalyst in the form of a ZSM5 catalyst having the following composition: $Na_{0.3}H_{3.8}[(AlO_2)_{4.1}(SiO_2)_{91.9}]$.

* * * * *